United States Patent [19]

Allen

[11] 3,961,471

[45] June 8, 1976

[54] PRODUCTION OF YARN

[75] Inventor: Lindsay Alfred Allen, Ilkley, England

[73] Assignees: IWS Nominee Co. Ltd.; Commonwealth Scientific and Industrial Research Organization, both of Canberra, Australia

[22] Filed: Sept. 4, 1974

[21] Appl. No.: 503,479

[52] U.S. Cl. ..... 57/140 J; 57/12; 57/36; 57/38.3; 57/91; 57/144; 57/156; 57/160

[51] Int. Cl.[2] ..... D02G 3/34

[58] Field of Search ..... 57/38.3, 91, 36, 157 R, 57/160, 156, 144, 140 J, 12, 139

[56] References Cited

UNITED STATES PATENTS

| | | | |
|---|---|---|---|
| 928,831 | 7/1909 | Wood | 57/139 |
| 2,332,395 | 10/1943 | Nutter et al. | 57/38.3 X |
| 3,053,040 | 9/1962 | Livingston | 57/91 |
| 3,148,416 | 9/1964 | Hornbuckle | 57/91 X |
| 3,334,483 | 8/1967 | Radcliffe | 57/157 R |
| 3,394,538 | 7/1968 | Neff | 57/38.3 |

FOREIGN PATENTS OR APPLICATIONS

| | | | |
|---|---|---|---|
| 908,589 | 4/1954 | Germany | 57/38.3 |
| 637,432 | 3/1962 | Italy | 57/91 |
| 50,209 | 4/1941 | Netherlands | 57/38.3 |
| 850,059 | 9/1960 | United Kingdom | 57/160 |

*Primary Examiner*—John Petrakes
*Attorney, Agent, or Firm*—Harold L. Stowell

[57] ABSTRACT

This invention provides a method of forming fancy yarns which does not require a fancy twisting frame. The method according to the present invention involves supplying a fibrous foundation strand and a fibrous effect strand to a pair of drafting rollers, the foundation strand being supplied from a drafting restraint such as a double apron and the fibrous effect strand being supplied immediately before the rollers without restraint whereby portions of the effect strand are snatched through the rollers and are incorporated into the foundation strand as randomly spaced irregularities which persist when the combined strands are spun into a yarn. The method can be used to make slub yarns, for example of wool, which may have a foundation including a synthetic multifilament reinforcing core. By back-twisting the resultant yarn with a binding yarn a slub gimp yarn can be produced.

8 Claims, 3 Drawing Figures

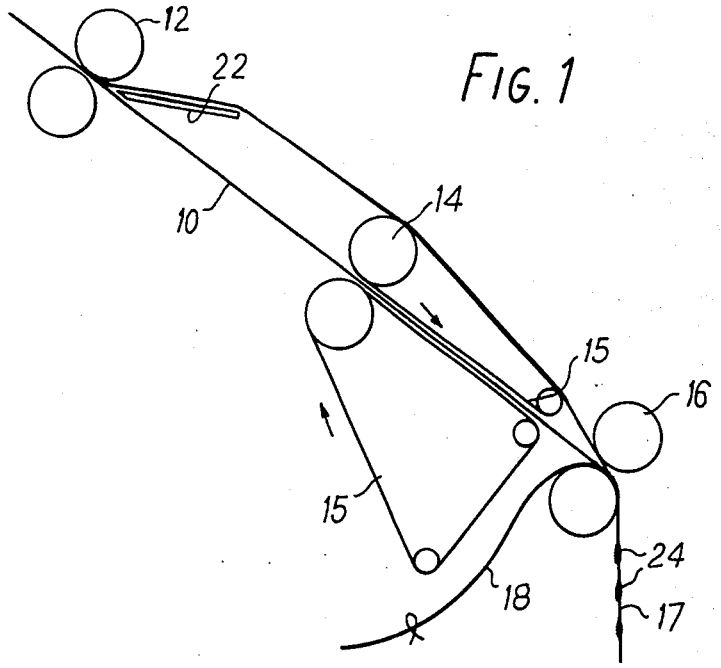
FIG. 1
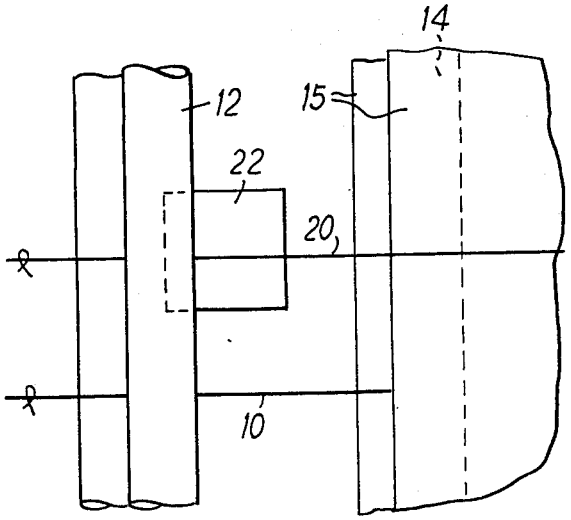
FIG. 2
FIG. 3
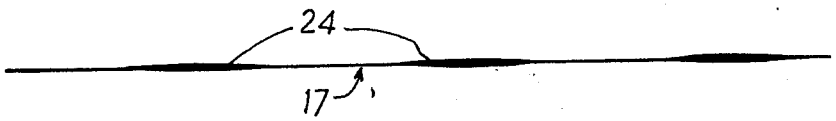

PRODUCTION OF YARN

This invention relates to a method of forming fancy yarns, such as slub yarns.

Fancy yarns are normally made on a fancy twisting frame on which a foundation and one or more effect yarns are twisted together in such a way as to produce irregular, or fancy, yarns. Fancy twisting frames are ordinarily equipped with such items as extra sets of rollers, or devices to accelerate or intermittently stop one set of rollers with respect to the rest.

The invention seeks to provide a method whereby fancy yarns, and more particularly slub yarns, may be made from a common supply of foundation and effect rovings on a spinning frame without requiring the use of intermittently accelerating or stopping rollers.

In the method according to the present invention a fibrous foundation strand is supplied to a pair of drafting rollers from a drafting restraint and a fibrous effect strand is supplied to the foundation immediately before the rollers without restraint whereby portions of the effect strand are snatched through the rollers and are incorporated with the foundation strand as irreglarities. The combined strands are preferably spun immediately into a yarn, in which the irregularities persist.

The irregularities of the yarn according to this invention are randomly spaced along the foundation yarn, which is desirable and advantageous, since regularly spaced slubs produce unwanted patterns in made-up fabrics.

The strands employed may be rovings with twist in them or twistless rovings, although the latter are preferred. However, in certain circumstances yarns may be used.

The method may be conveniently carried out on a double-apron drafting system on a spinning frame wherein the aprons provide the drafting restraint for the foundation roving. The foundation roving may pass through the system in the normal way while the effect roving bypasses the apron rollers, thus arriving at the front drafting rollers without the control exercised by the aprons.

The combined rovings are then spun onto a twisting spindle from a traveller and form a slub yarn. The aprons control the feed of the foundation roving to the front drafting rollers within the drafting zone and allow it to be drafted smoothly without snatching. The effect roving, without the benefit of the aprons, is snatched, and forms slubs on the resultant yarn. It is not necessary, in the method of the invention, to use an effect roving having a shorter fibre length than the foundation roving.

An important advantage of the invention is that a fancy yarn can be produced on a spinning frame with only a simple modification, thus obviating the need for an expensive fancy twisting frame.

The invention will be described further, by way of example, with reference to the accompanying drawings in which:

FIG. 1 is a diagrammatic side elevation of a drafting system operating the process of the invention;

FIG. 2 is a partial plan view of the system of FIG. 1; and

FIG. 3 is a diagrammatic view of a typical resultant yarn.

A wool roving 10 (the "foundation" roving) is passed through the nip of a first pair of drafting rollers 12. The roving 10 is guided and partially drafted by apron rollers 14 round which pass a pair of aprons 15, whence it passes to front drafting rollers 16. The rollers 12, 14 and 16 form a conventional double apron drafting system. After leaving the front drafting rollers 16 the roving is spun onto a twisting spindle (not shown) to form a yarn. The front drafting rollers 16 are set to run at about twenty times the speed of the rollers 12 to produce a fine yarn and, in order to give strength to the resultant yarn 17, a nylon multi-filament 18 is introduced to the wool roving 10 jut before the front drafting rollers 16.

A second wool roving 20 (the 'effect' roving) is also passed through the rollers 12. The effect roving 20 is kept separate from the foundation roving 10 (see FIG. 2), and an inclined plate 22, acting as a guide for the roving 20, is disposed just downstream of the rollers 12 to direct the path of the effect roving 20 over the apron rollers 14 and prevent the roving 20 from being dragged into the nip of the apron rollers 14.

It has been found that it is not necessary to maintain the effect roving 20 clear of the drafting apron since it will usually run over the top surface of the upper apron without difficulty even though the latter is moving in the opposite direction.

The apron rollers 14, and therefrom the aprons 15, run at a sped slightly greater than that of the rollers 12 and provide a restriction on the foundation roving 10 during drafting. The paths of rovings 10,20 converge at the front drafting rollers 16 and the front drafting rollers 16 tend to snatch portions off the effect roving 20 which is not supported by aprons, that is, causing varying portions of the effect roving to be pulled. These portions appear in the resultant yarn 17 as slubs 24.

Thus in the method of the invention one roving, the foundation roving, is subjected to even controlled drafting by the normal use of a double apron drafting system, and the effect roving is drafted without restraint by by-passing the aprons. The output from the front rollers is at once spun into a yarn, and the result is an even foundation yarn with lumps, or slubs, of the unevenly effect roving randomly spaced along its length. It must be pointed out that the effect roving is drafted unevenly, not discontinuously: greater or lesser numbers of fibres are pulled through the front rollers in a random manner. Only very rarely does the effect roving actually break; when of course the machine must be halted and set-up afresh, as is normal practice when yarn-breakage occurs in such machinery.

Although the above has been described with reference to a reinforced wool 'core' yarn employed as the foundation, it will be appreciated that any natural or synthetic or blended yarn or roving may be employed to provide the foundation, although a wool core yarn is preferred for strength and appearance. The core may be of any suitable material, but a synthetic multifilament is preferred. Of course, a core yarn need not be used where the strength of the foundation roving is sufficient by itself.

Similarly, the effect roving may be of any suitable textile fibres and may be the same as or different from the foundation, although it is an advantage of the invention that the rovings may come from a common supply. Likewise the colour of the effect may be the same as or different from that of the foundation.

If desired two or more effect strands may be used, but care must be taken to minimise interference or snarling.

The yarn produced by the method described is a slub yarn but by minor modifications different fancy yarns may be produced. For example, by back twisting the resultant yarn 17 with a binding yarn a slub gimp yarn may be produced.

I claim:

1. A method of forming fancy yarns comprising the steps of:

providing a plurality of strands of staple fibre to constitute foundation and effect strands;

passing said foundation strand and at least one effect strand through a first pair of drafting rollers;

passing said foundation strand through drafting restraint surfaces moving at a speed greater than the speed of the first pair of drafting rollers to a second pair of drafting rollers having a greater speed than the drafting restraint surfaces;

passing the at least one effect strand into engagement with said foundation strand without passage between said drafting restraint surfaces;

causing said second pair of drafting rollers to rotate to cause drafting of said strands and to pull in varying portions of said effect strand while constraining said foundation strand by the action of said drafting restraint;

incorporating said portions of said effect strand with said foundation strand as irregularities;

and spinning said drafted strands together to form yarn in which said irregularities persist as slubs in the yarn.

2. The method of claim 1 wherein two or more effect strands are used.

3. The method of claim 1 wherein a reinforcing strand is introduced into the foundation strand to produce a resultant yarn having a core yarn foundation.

4. The method of claim 1 wherein at least one of said foundation and effect strands comprises wool fibres.

5. The method of claim 3 wherein the reinforcing strand is a synthetic multifilament.

6. A method of forming a fancy yarn in which irregularities constitued by an effect strand are supported by a foundation strand, said method comprising the steps of:

providing a plurality of strands of staple fibre to constitute respectively said foundation and effect strands;

passing said foundation strand and at least one effect strand through a first pair of drafting rollers;

passing said foundation strand between a pair of cooperating aprons, said aprons moving in the same direction as said strand;

passing said foundation strand from said aprons to a second pair of drafting rollers, said second rollers being rotated at a peripheral speed greater than that of said first rollers and said aprons moving with a peripheral speed intermediate that of said pairs of rollers whereby said aprons serve as drafting restraint on said foundation strand and constrain said strand to be continuously drafted;

passing said effect strand from said first pair of rollers to said second pair and into engagement with said foundation strand without passage between said aprons, the speed of said second pair of rollers in relation to that of said first pair causing portions of said effect strand to be pulled in varying portions and incorporated with said foundation strand as irregularities thereon;

and twisting said drafted strands to form yarn in which said irregularities persist.

7. The method of claim 6 including the step of passing a reinforcing strand to said second drafting rollers and into engagement with said foundation strand whereby said reinforcing strand is incorporated in said foundation strand to give a resultant yarn of core yarn structure.

8. Fancy yarn produced by the method of claim 1.

* * * * *

UNITED STATES PATENT OFFICE

CERTIFICATE OF CORRECTION

PATENT NO. : 3,961,471

DATED : June 8, 1976

INVENTOR(S) : LINDSAY ALFRED ALLEN

It is certified that error appears in the above-identified patent and that said Letters Patent are hereby corrected as shown below:

Foreign Application Priority Data

September 10, 1973 British ..... 42386

Signed and Sealed this

Seventh Day of September 1976

[SEAL]

*Attest:*

RUTH C. MASON
*Attesting Officer*

C. MARSHALL DANN
*Commissioner of Patents and Trademarks*